United States Patent [19]

Means et al.

[11] 3,956,991

[45] May 18, 1976

[54] OPTICAL, SEMI-ACTIVE BOMBLET FUZE

[75] Inventors: James E. Means, Corona; Matthew E. Anderson, Ontario, both of Calif.

[73] Assignee: The United States of America as represented by the Secretary of the Navy, Washington, D.C.

[22] Filed: Oct. 3, 1968

[21] Appl. No.: 765,749

[52] U.S. Cl. ..... 102/70.2 P

[51] Int. Cl.[2] ..... F42C 13/02

[58] Field of Search ..... 102/70.2, 70.2 P, 79, 102/80

[56] References Cited

UNITED STATES PATENTS 3,485,461 12/1969 Katsanis ..... 102/70.2

*Primary Examiner*—Verlin R. Pendegrass

*Attorney, Agent, or Firm*—Richard S. Sciascia; Joseph M. St. Amand

[57] ABSTRACT

A semiactive bomblet fuze having both contact and proximity fuze capability for a free-fall weapon, and utilizing both a gyro-rotor aligning fuze train and an optical lens for initiating a light sensitive explosive detonator.

5 Claims, 4 Drawing Figures

MATHEW E. ANDERSON
JAMES E. MEANS
INVENTORS

BY J. M. St. Amand
ATTORNEY

OPTICAL, SEMI-ACTIVE BOMBLET FUZE

The invention herein described may be manufactured and used by or for the Government of the United States of America for governmental purposes without the payment of any royalties thereon or therefor.

This invention is related to U.S. Pat. application Ser. No. 766,035, filed Oct. 3, 1968 for Semiactive Electro-optical Bomblet Fuze.

While previous types of electronic bomblet proximity fuzes are expensive, complex, require battery power supplies and are subject to storage problems, countermeasures and prefires from crosstalk between other bomblets and canopy over a target, the fuze of the present invention avoids these problems.

The present fuze utilizes a lens system and a light sensitive explosive detonator which is matched to and initiated by high-intensity energy in light from flash charges or pyrotechnic sources.

Other objects and many of the attendant advantages of this invention will become readily appreciated as the same becomes better understood by reference to the following detailed description when considered in connection with the accompanying drawings wherein.

Referring now to the drawings, like numerals refer to like parts in each of the figures.

Bomblets can be deployed, for example, by loading a warhead cannister with a small number of low-drag initiator bomblets filled with a material for generating a large quantity of ultraviolet light such as an argon bomb for example, that will upon impact with the ground or a target emit a high-intensity pulse of energy with a band of particular wavelength, and a large number of high-drag payload bomblets. The payload bomblets are equipped with a proximity fuze, hereinafter described containing a light initiated explosive detonator sensitive to the wavelength of energy pulses emitted from the ground bursts of the initiator bomblets. The two types of bomblets have a difference in drag coefficients to result in an approximately constant height of burst for the payload bomblets. The low-drag initiator bomblets fall faster and reach the ground or target prior to the high-drag payload bomblets resulting in detonation of the fragmentation payload bomblets above the targets by the high-energy light pulses from the initiator bomblets. The payload bomblets can also be detonated by contact.

Figure 1A:
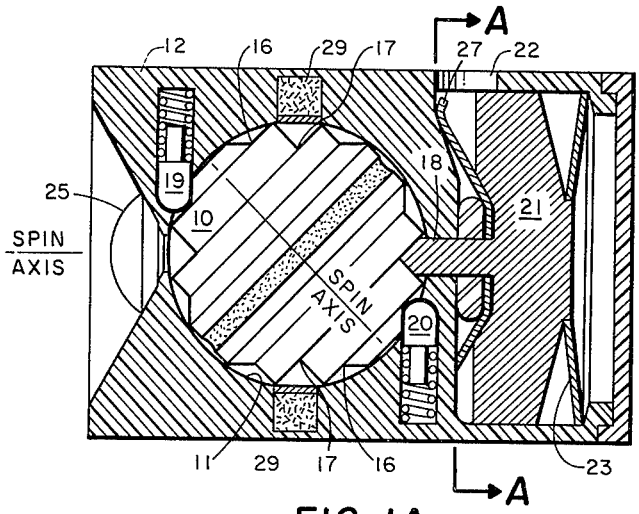
FIG. 1A shows one embodiment of a fuze of the present invention in safe position, partially in cross-section along the fuze spin-axis.
Figure 1B:
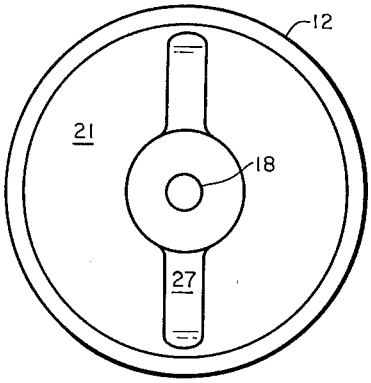
FIG. 1B is a cross-section along line A—A of FIG. 1A.

An optical proximity fuze for use in payload bomblets is shown in FIGS. 1 and 2 and hereinafter described. Fuzes of the present invention would normally be employed in bomblets such that the spin axes of both fuze and bomblet are coincident.

The spin-and-pressure-armed bomblet fuze of the present invention utilizes a light-initiated detonator. This fuze achieves an out-of-line explosive train by means of a firing-train-aligning gyro rotor 10 within a spherical chamber 11 in fuze housing 12. Two detonators 14 and 15 are contained within the gyro rotor 10 along its spin-axis. Detonator 14 is light sensitive and detonator 15 is stab-sensitive.

Figure 2A:
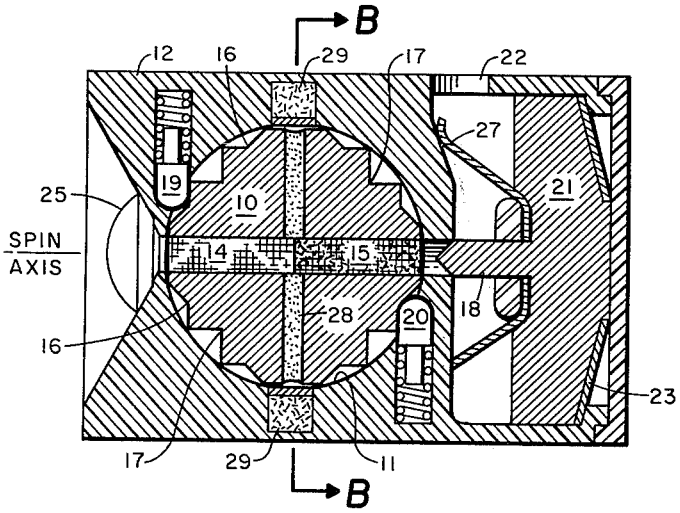
FIG. 2A is a cross-sectional view similar to FIG. 1A but showing the fuze in armed position.
Figure 2B:
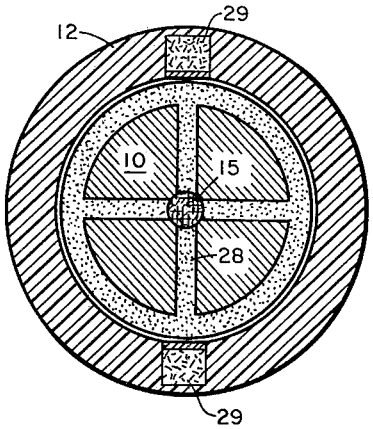
FIG. 2B is a cross-sectional view taken along line B—B of FIG. 2A.

Gyro rotor 10 is of slightly smaller diameter than chamber 11 and is operable to slideably rotate therein. Rotor 10 is substantially spherical in shape having grooves 16 and 17 thereabout normal to its spin axis for locking purposes, and the material of the rotor in the region about the circumference thereof normal to its spin axis is of a heavier weight than the remaining portion. The gyro-rotor is maintained in the safe position shown in FIG. 1A by a stab-detent 18 which fits into groove 17 and two centrifugally actuated detents or spring locks 19 and 20 which fit into grooves 16 about the rotor. High-pressure gas applied against inertial weight 21 via pressure access hole 22 after safe separation of the bomblet from a launch vehicle causes a Belleville spring 23, for example, to toggle over to a position as shown in FIG. 2A. When the bomblet containing the fuze reaches a minimum spin speed after dispersal, spring locks 19 and 20 are moved by centrifugal force permitting gyro-rotor 10 to rotate within its spherical chamber 11 and align its spin-axis with the spin axis of the fuze, and in turn align the explosive train to the armed position of FIG. 2A. Then when the spin of the bomblet containing the fuze is decreased, upon deployment of a drogue for example, spring locks 19 and 20 will return to their original position locking gyro-rotor 10 in the armed position.

The explosive train consists of a light-sensitive detonator 14 at one end of gyro-rotor 10 aligned with a focusing lens 25 mounted along the spin-axis in the forward end of fuze housing 12, and a stab-sensitive detonator 15 on the opposite end of rotor 10 aligned with inertially actuated stab-detent 18. Stab-detent 18, which extends from inertial weight 21 and is held back by leaf spring 27 after arming, acts as a back-up for end-on impacts with a target. Lens 25 concentrates light of desired wavelength onto light sensitive explosive detonator when the fuze is in armed position. As shown in the position of FIG. 2A inertial weight 21 is poised to force stab-detent 18 forward to actuate stab-sensitive detonator 15 upon impact. The explosive output from both detonators 14 and 15 goes to toroidal explosive lead 28, FIG. 2B, then to output explosive leads 29 and the main bomblet explosive.

The arming spin rate can be controlled by the springs on the centrifugal spring locks 19 and 20. In this fuze there is no stored energy that might accidentally drive rotor 10 toward the armed condition.

Obviously many modifications and variations of the present invention are possible in the light of the above teachings. It is therefore to be understood that within the scope of the appended claims the invention may be practiced otherwise than as specifically described.

What is claimed is:

1. A proximity fuze for submunitions primarily initiated from high-intensity light sources whose wavelength is of a select bandwidth, comprising, a. a cylindrical fuze housing whose spin axis coincides with the cylinder axis, b. a spherical chamber in a forward portion of said housing along said spin axis, c. an opening between the forward end of said housing and said spherical chamber, d. an optical lens means mounted in said opening for focusing and concentrating high-intensity light of select bandwidth from an external source to a point just within said chamber, e. a gyro rotor having a diameter slightly less than the diameter of said spherical chamber and operable to slideably rotate therein to align its spin axis with the spin axis of said fuze housing, f. a passage through said rotor along its spin axis, g. a light-sensitive explosive detonator contained in said rotor passage at its forward end, h. an inertially actuated stab-detent means mounted in a rearward portion of said fuze housing, i. a stab-sensitive explosive detonator contained in said rotor passage at its rearward end, j. an output explosive lead between said spherical chamber and the outer wall of said fuze housing, k. a torroidal explosive lead leading from said light-sensitive detonator and from said stab-sensitive detonator to the outer periphery of said rotor and which completes an explosive train between said detonators and said output explosive lead when said rotor spin axis is aligned with the fuze housing spin axis, l. locking means for locking said rotor in safe position with its spin axis out of alignment with the fuze housing spin axis, m. said locking means operable to release said rotor when said fuze is rotated about its spin axis at a certain minimum speed following safe separation of the fuze from a launch vehicle allowing said rotor to rotate and move to armed position aligning its spin axis with that of said fuze, thus aligning said light-sensitive explosive detonator with said optical lens means and said stab-sensitive explosive detonator with said stab detent means and then locking said rotor in armed position when the rotation of said fuze about its spin axis is reduced below said minimum speed, wherein when in armed position a concentration of high-intensity light of proper bandwidth focused onto the forward end of said light-sensitive explosive detonator by said optical means will result in detonation thereof and wherein head-on impact will cause said stab-detent means to stab said stab-sensitive explosive detonator resulting in detonation thereof.

2. A proximity fuze as in claim 1 wherein in addition to said locking means said rotor is initially also maintained in safe position by said stab-detent means which is actuated by an actuating means to release said rotor following safe separation of the fuze from the launch vehicle.

3. A fuze as in claim 1 wherein said stab-detent means extends from a piston shaped inertial weight which forces said stab-detent forward upon headon impact.

4. A fuze as in claim 1 wherein said locking means include spring means which are centrifugally operated and said minimum speed for allowing arming is controlled by said spring means.

5. A fuze as in claim 1 wherein said high-intensity light of proper bandwidth is provided by impact-initiated flash charges which are launched from said launch vehicle with said fuze.

* * * * *